US006130163A

United States Patent [19]

Yi et al.

[11] Patent Number: 6,130,163

[45] Date of Patent: Oct. 10, 2000

[54] STABILIZATION OF SLURRY USED IN CHEMICAL MECHANICAL POLISHING OF SEMICONDUCTOR WAFERS BY ADJUSTMENT OF PH OF DEIONIZED WATER

[75] Inventors: Champion Yi, Hsinchu Hsien; Ching-feng Tsai, Hsinchu; Jiun-Fang Wang, Hain-chu, all of Taiwan

[73] Assignees: ProMOS Technologies, Inc.; Mosel Vitelic, Inc., both of Hsinchu, Taiwan; Infineion AG, Munich, Germany

[21] Appl. No.: 09/326,400

[22] Filed: Jun. 3, 1999

[51] Int. Cl.[7] ..... H01L 21/00

[52] U.S. Cl. ..... 438/692; 156/345; 216/88; 216/85; 438/8; 438/745

[58] Field of Search ..... 438/8, 692, 16, 438/693, 745; 216/85, 38, 88–89, 93; 156/345 LP, 345 LC

[56] References Cited

U.S. PATENT DOCUMENTS

| | | | |
|---|---|---|---|
| 4,319,923 | 3/1982 | Falanga et al. | 216/93 X |
| 5,863,838 | 6/1999 | Farkas et al. | 438/692 X |
| 5,885,334 | 3/1999 | Suzuki et al. | 438/692 X |
| 5,922,620 | 7/1999 | Shimomura et al. | 438/690 X |

*Primary Examiner*—William Powell
*Attorney, Agent, or Firm*—Blakely, Sokoloff, Taylor & Zafman LLP

[57] ABSTRACT

A method of reducing agglomerated particles in a slurry for use in a chemical mechanical polishing (CMP) machine, the CMP machine also using deionized water, is disclosed. The method comprises the steps of: monitoring the pH of the slurry that is provided to the CMP machine; monitoring the pH of the deionized water that is provided to the CMP machine; and adjusting the pH of the deionized water to be substantially the same as the pH of the slurry.

3 Claims, 2 Drawing Sheets

STABILIZATION OF SLURRY USED IN CHEMICAL MECHANICAL POLISHING OF SEMICONDUCTOR WAFERS BY ADJUSTMENT OF PH OF DEIONIZED WATER

FIELD OF THE INVENTION

The present invention relates to slurries used in chemical mechanical polishing (CMP), and more particularly, to a method for discouraging the formation of agglomerate particles in the slurry by controlling the pH of the deionized water used in the CMP apparatus.

BACKGROUND OF THE INVENTION

Chemical mechanical polishing is one of the many steps commonly used in the manufacture of integrated circuits. As detailed in many prior art patents, chemical mechanical polishing, or simply "CMP," is the process of polishing the surface of a semiconductor wafer in order to remove material from the surface of the wafer. The polishing is typically performed by rotating a polishing pad against the semiconductor wafer. A slurry of some sort is used to facilitate the polishing process. Depending upon the material that is to be removed from the semiconductor wafer, the composition of the polishing pad and the composition of the slurry varies.

For example, in the CMP of tungsten material from the surface of a wafer, the slurry will include an oxidizer, which is typically ferric nitrate crystals ($Fe(NO_3)_3$). The ferric nitrate crystals are usually diluted in deionized water and then mixed with aluminum oxide ($Al_2O_3$) before being introduced into the CMP apparatus. Examples of slurry compositions are detailed in U.S. Pat. No. 5,783,489 to Kaufman et al. and the patents cited therein.

These slurries shown in the '489 patent and other slurries typically include silica, alumina, ceria, titania, and/or zirconia abrasive particles. These particles are suspended in a liquid naturally or by adding a surfactant. Nevertheless, one known problem with CMP slurries is that, for a variety of reasons, the particulates in the slurry may gel or flocculate. The flocculation may result from a change in pH level, heat, light, sedimentation in the delivery system at low flow rates, shear forces, metal contaminants, and other particle interaction. If this occurs, the agglomerate particles may scratch the surface of the wafer. These defects can result in short circuiting of metal interconnect layers. The defects may be singular or may be of the "skipping stone" type.

Therefore, what is needed is a method of minimizing the amount of agglomeration of particles in the CMP slurry.

SUMMARY OF THE INVENTION

A method of reducing agglomerated particles in a slurry for use in a chemical mechanical polishing (CMP) machine, said CMP machine also using deionized water, is disclosed. The method comprises the steps of: monitoring the pH of said slurry that is provided to said CMP machine; monitoring the pH of said deionized water that is provided to said CMP machine; and adjusting the pH of said deionized water to be substantially the same as the pH of said slurry.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

As noted above, it is believed that large agglomerated particulates cause defects to be formed on the semiconductor wafer during the polishing process. Thus, the goal of the present invention is to prevent the formation of these particulates in the slurry. Although extremely fine mesh physical filters may be used to filter the agglomerate particles, because the particles can be extremely small, the filtering may be ineffective, or may be cost-prohibitive. Therefore, the present invention provides a method for reducing or eliminating the amount of agglomerate particles in the slurry delivered to the CMP apparatus.

Specifically, the present invention relates to the agglomeration of particles caused by pH shock, or the change in pH level of the slurry due to outside influences. As is known in the art, deionized water is used by CMP machines for various purposes. For example, for concentrated slurries, deionized water is used to dilute the slurry in the slurry distribution system. Deionized water is also used to flush and clean the piping in the slurry distribution system and the CMP machines during routine preventive maintenance. Deionized water is also commonly used to rinse and wash the polishing pad of the CMP machine between wafers and between runs. Finally, deionized water is also used to condition the polishing pad. Thus, it can be seen that deionized water is used in very important aspects of the CMP process.

Typically, the deionized water is neutral, i.e., has a pH of 7. In contrast, the slurries used in the CMP process may have a pH of 10 for a dielectric CMP slurry down to a pH below 4 for a metal CMP slurry. Inevitably, the slurry will be in contact with deionized water. It has been found that a highly acid or base slurry coming in contact with the neutral deionized water will suffer "pH shock". The pH shock will cause agglomeration of the particles, which as noted above, will lead to increased defects during the CMP process. The present invention attempts to eliminate the pH shock by adjusting the pH of the deionized water to match that of the slurry being currently used by the CMP machine.

Figure 1:
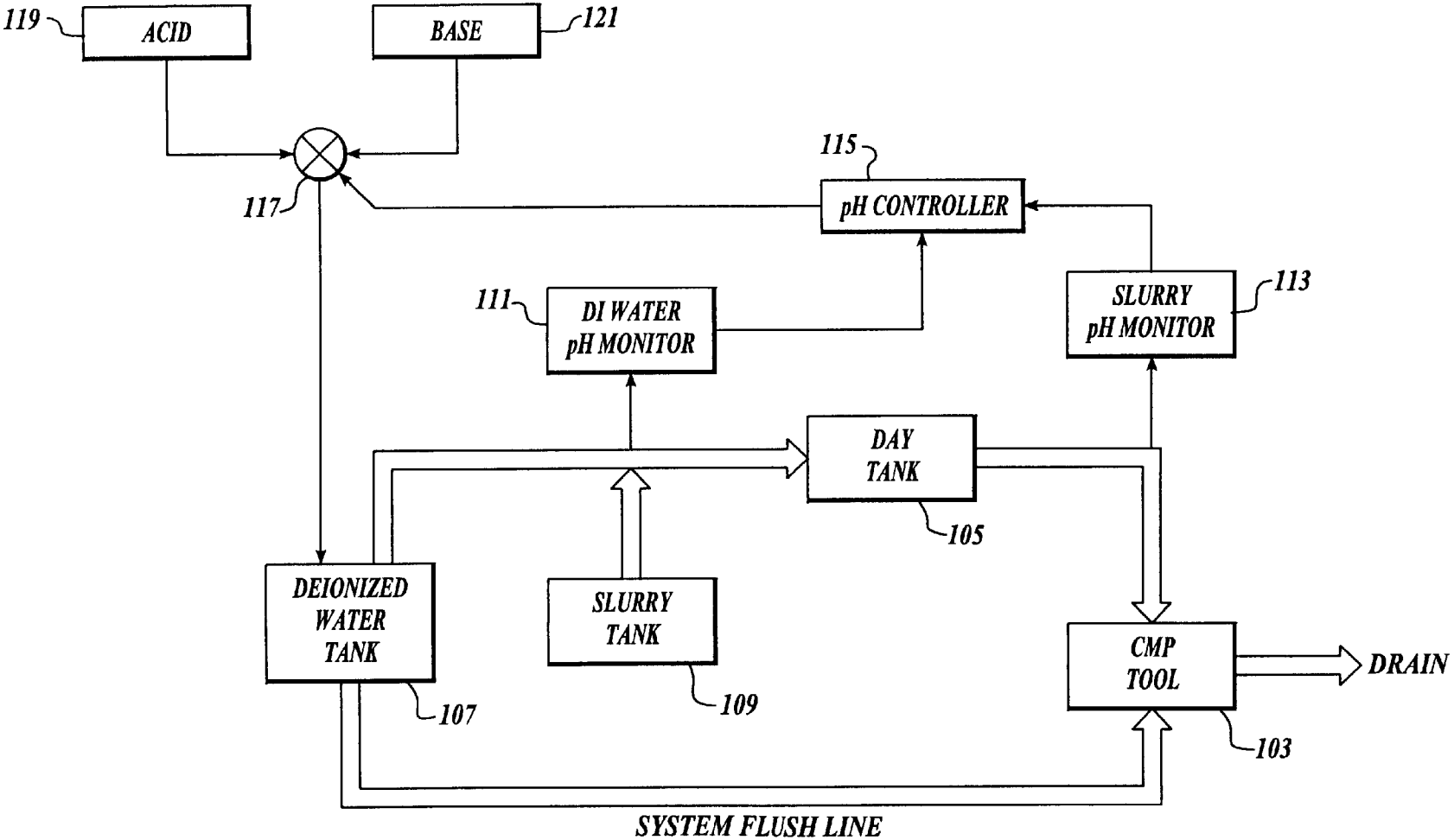
FIG. 1 illustrates in schematic form the preferred embodiment of the present invention.

Turning to FIG. 1, a CMP polishing system 101 in accordance with the present invention is shown. The system 101 includes a CMP tool 103 that receives slurry from a day tank 105. The day tank 105 is a reservoir that holds the slurry that will be used for that day or other predetermined period of time. After the slurry has been used by the CMP tool 103, the slurry is disposed of through a drain system.

Feeding the day tank 105 is a slurry tank 107 and a deionized water tank 107. The slurry tank 107 contains a reservoir of slurry, typically in concentrated form. The deionized water tank 107 contains deionized water that is used for mixing with the slurry from the slurry tank 107 in order to dilute the slurry. Also, a system flush line between the deionized water tank 107 and the CMP tool 103 is provided. This flush line provides water to the CMP tool for pad or wafer rinsing and system flush. The foregoing elements of the system 101 are of conventional design.

The present invention modifies this design by adding a system for monitoring and adjusting the pH of the deionized water to match that of the slurry. In particular, a slurry pH monitor 113 is provided for monitoring the pH of the slurry being delivered from the day tank 105 to the CMP tool 103. The slurry pH monitor 113 is of conventional design and can rapidly determine the pH of the slurry. The pH information for the slurry is provided to a pH controller 115.

Similarly, a deionized water pH monitor 111 is provided for monitoring the pH of the deionized water being delivered from the deionized water tank 107 to the day tank 105. The deionized water pH monitor 111 is of conventional design and can rapidly determine the pH of the water. The pH information for the deionized water is provided to the pH controller 115. In the preferred embodiment, the pH controller 115 is a commercially available microprocessor.

Figure 2:
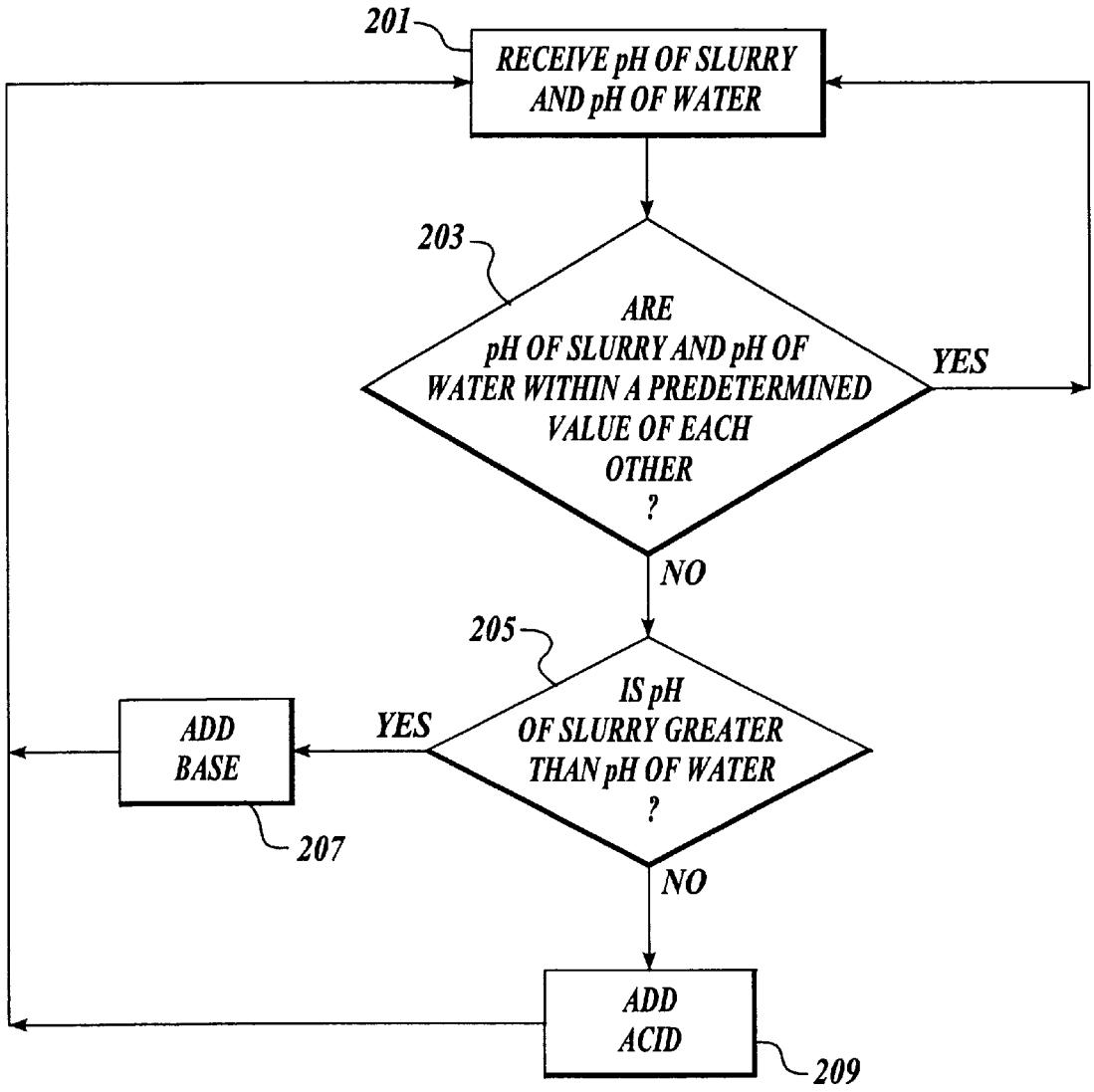
FIG. 2 is a flow diagram illustrating how the pH controller of the present invention operates to balance the pH of the deionized water and the slurry.

The pH controller is operative to compare the pH of the deionized water with the pH of the slurry. This procedure can be seen in FIG. 2, which is a flow diagram of the logic contained in the pH controller 115.

First at a step 201, the pH for the slurry and the pH for the water is received by the pH controller 115. Next, at step 203, a determination is made to determine if the pH of the two fluids are within a predetermined range from each other. If yes, then the pH controller 115 takes no action and returns to monitoring the pH levels at step 201. For example, if the pH of the slurry is 5.3 and the pH of the water is 5.4, and the predetermined range is 0.2, then no action is taken.

However, if the pH controller 115 finds that a large difference in pH between the slurry and the water exists, then at step 205, a determination is made as to whether the pH of the slurry is greater than the pH of the water. If the pH of the slurry is greater than the pH of the water, then this indicates that the slurry is more base-like than the water. Thus, at step 207, a valve 117 is directed to add base from a base tank 121 to the deionized water tank 107. The base may be KOH (inorganic) or $NH_4OH$ (inorganic) or organic bases such as amines.

However, if the pH of the slurry is not greater than the pH of the water, then this indicates that the slurry is more acid-like than the water. Thus, at step 209, the valve 117 is directed to add acid from an acid tank 119 to the deionized water tank 107. The acid may be $HNO_3$ (inorganic acid) or citric acid (organic acid) or any other acid.

The goal of this closed loop system is to ensure that the pH of the deionized water is closely matched with the pH of the slurry being delivered to the CMP tool 103. Because the CMP polishing system is kept in a near constant pH environment, the pH shock is reduced, resulting in lower particle agglomeration. This in turn lowers the amount of defects during the CMP process. Moreover, because of the reduced gelling and agglomeration, the frequency of preventive maintenance of the slurry delivery system can be lowered.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of reducing agglomerated particles in a slurry for use in a chemical mechanical polishing (CMP) machine, said CMP machine also using deionized water, the method comprising the steps of:

monitoring the pH of said slurry that is provided to said CMP machine;

monitoring the pH of said deionized water that is provided to said CMP machine; and adjusting the pH of said deionized water to be substantially the same as the pH of said slurry.

2. The method of claim 1 wherein the step of adjusting comprises adding base to said deionized water if the pH of said slurry is greater than the pH of said deionized water and adding acid to said deionized water if the pH of said slurry is less than the pH of said deionized water.

3. An improved CMP polishing system that reduces the amount of agglomeration in a slurry, said CMP polishing system also using deionized water, said system comprising:

means for monitoring the pH of said slurry that is used in said CMP polishing system;

means for monitoring the pH of said deionized water that is used in said CMP polishing system; and means for adjusting the pH of said deionized water to be substantially the same as the pH of said slurry.

* * * * *